US005709390A

United States Patent [19]

Faccoli

[11] Patent Number: 5,709,390

[45] Date of Patent: Jan. 20, 1998

[54] ELASTOMERIC SEALING GASKET FOR COOKING OVEN DOORS

[75] Inventor: Angelo Faccoli, Brescia, Italy

[73] Assignees: Posa S.p.A., Milan, Italy; Techno, L.L.c., Northport, Mich.

[21] Appl. No.: 693,864

[22] Filed: Aug. 5, 1996

[30] Foreign Application Priority Data

Aug. 4, 1995 [EP] European Pat. Off. ..... 95830359

[51] Int. Cl.[6] ..... F16J 15/12

[52] U.S. Cl. ..... 277/166; 277/189; 49/489.1; 49/493.1

[58] Field of Search ..... 277/166, 181, 277/182, 184, 189, 215; 49/475.1, 479.1, 483.1, 489.1, 490.1, 493.1

[56] References Cited

U.S. PATENT DOCUMENTS

| | | | |
|---|---|---|---|
| 1,657,520 | 1/1928 | Vaillancourt | 49/489.1 |
| 1,688,458 | 10/1928 | Eveleth | 49/493.1 |
| 1,763,603 | 6/1930 | Donahue | 49/489.1 |
| 1,808,423 | 6/1931 | Macklanburg | 49/493.1 |
| 2,546,049 | 3/1951 | Weaver et al. | 49/493.1 |
| 2,665,458 | 1/1954 | Wilcox | 49/493.1 |
| 2,676,055 | 4/1954 | Humpal | 49/489.1 |
| 2,909,819 | 10/1959 | Fernberg | 49/493.1 |
| 3,165,793 | 1/1965 | Lynch | 49/479.1 |
| 3,382,619 | 5/1968 | Bemis | 49/493.1 |
| 3,404,675 | 10/1968 | Payne | 49/493.1 |
| 4,223,660 | 9/1980 | Lang | 277/166 |
| 4,248,017 | 2/1981 | Micallef | 49/493.1 |
| 4,305,182 | 12/1981 | Peterson | 49/493.1 |
| 4,308,305 | 12/1981 | Albrecht | 49/479.1 |
| 4,417,420 | 11/1983 | Marsh | 49/493.1 |

FOREIGN PATENT DOCUMENTS

| | | |
|---|---|---|
| 0277098 | 6/1988 | European Pat. Off. . |
| 2106974 | 4/1983 | United Kingdom . |

*Primary Examiner*—Scott Cummings
*Attorney, Agent, or Firm*—Kevin M. Farrell

[57] ABSTRACT

An elastomeric sealing gasket particularly for cooking oven doors, to be placed between a front edge of the oven and the door of the oven itself, comprising a continuous strip, provided with metal elements, having respective hooks for engagement in corresponding holes provided in the oven structure, in which said metal hooking elements comprise a base provided with transverse notches, said base being seamed to an outer longitudinal rib on the strip and subsequently being bent in the case of hooking elements placed in the corners of the gasket.

11 Claims, 5 Drawing Sheets

ELASTOMERIC SEALING GASKET FOR COOKING OVEN DOORS

The present invention relates to an elastomeric sealing gasket, made in particular of silicone rubber, particularly for cooking oven doors.

As is known, elastomeric sealing gaskets placed between the oven door and a front edge of the oven itself are commonly used in cooking ovens to prevent heat loss during use.

These gaskets may be full-frame, that is consisting of four sides joined together to form a rectangle, or open frame with three-sides, that is without the lower side, from which there is normally less heat loss.

These gaskets were originally obtained by joining together a plurality of pieces whose length coincided with that of the frame and fixing them to the oven by suitable hooking means, provided in the gasket, that engaged in special holes provided in the oven structure.

For reasons of economy, the gaskets which are currently used are obtained by bending, and possibly joining at the end, a single hollow strip with hooking means situated at least in the areas where the strip is bent, that is at the corners of the frame. Metal inserts having a widened base that is inserted in a corresponding slit made in the flat bottom wall of the gasket are used as hooking means.

Said widened base of the corner insert is curved in a crescent-shape and is almost always manually inserted into the hollow part of the gaskets through the hole provided on the bottom of the gasket itself. A hook that engages in a corresponding hole provided on the oven structure protrudes from the base of the metal insert through the hole provided in the gasket.

For gaskets with three sides, two terminal metal inserts are provided that are inserted through the ends of the gasket and are normally fixed with adhesive.

Gaskets of this type are described as an example in GB-A-2.106.974 and EP-A-2 77098.

These gaskets with metal inserts have various drawbacks:

firstly, the need to have a tubular strip, which has a high cost, also because more material must be used, mainly to provide the hollow inside;

difficulty in assembling the metal inserts in the gasket and difficulty in automating this operation;

possibility of tears in the gasket in the areas where the holes or slits for insertion of the metal inserts are provided;

need to use preformed metal inserts which therefore cannot be adapted to a different radius of curvature if required;

additional costs in the event that silicone adhesive is used to fix the inserts.

The aim of the invention is to eliminate the aforementioned drawbacks, providing a gasket for cooking oven doors that is extremely economical, allows rapid fixing of the metal hooking elements, even with an automated procedure, and that allow simple and rapid joining of the ends, in the event that this forms a closed frame.

These aims are achieved by the gasket according to the invention which has the characteristics listed in attached claim 1.

Preferred embodiments of the invention appear from the dependent claims.

The gasket according to the invention is obtained from an extruded strip having a rib running lengthwise for seaming of metal hooking elements.

These metal hooking elements advantageously have a base provided with a plurality of crosswise notches, which is mechanically seamed to said rib, and a hook protruding from said base for engagement in a hole in the oven structure.

Thanks to said notches on their bases the hooking elements can be bent to give them a curved shape, which is necessary when these elements are placed at the corners of the frame.

This bending of the bases of the metal hooking elements can be done when they are fitted on the gasket or, more advantageously, during installation of the gasket on the oven. In the latter case there is the advantage of obtaining bending virtually automatically during fitting of the gasket, when it is slightly stretched to bring the various hooks into engagement with the corresponding holes provided in the oven structure.

Further characteristics of the invention will be made clearer by the detailed description that follows, referring to a purely exemplary and therefore non-limiting embodiment, illustrated in the attached drawings in which.

Figure 6A:
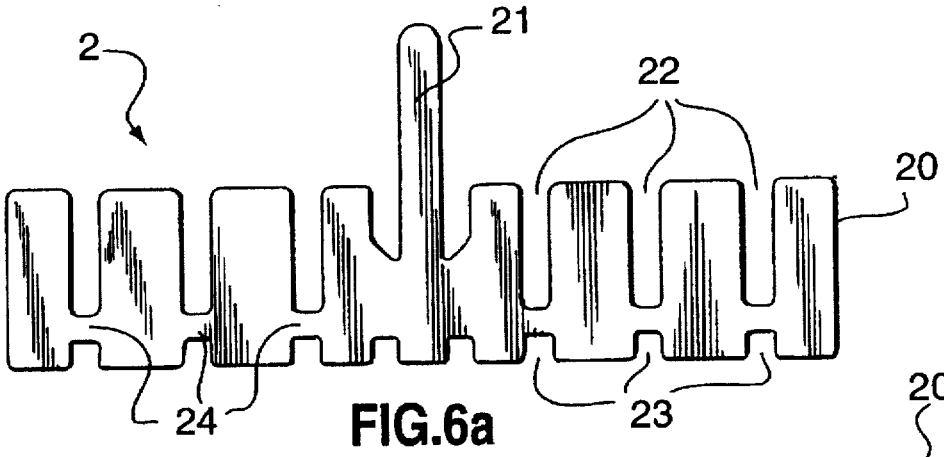
Figure 6C:
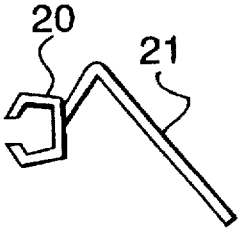
Figure 6B:
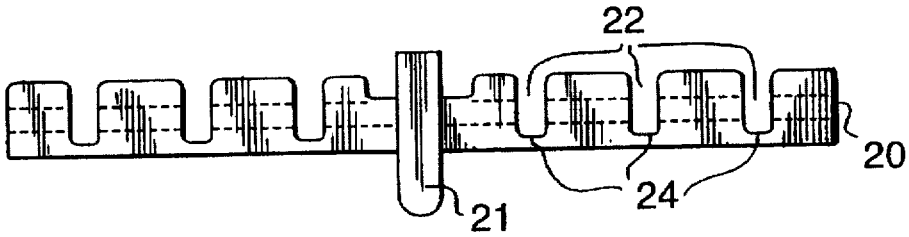

FIG. 6*a* is a plan view of a metal hooking element before seaming to the gasket;

FIG. 6*b* is a plan view of the metal hooking element in FIG. 6*a* after seaming;

FIG. 6*c* is an end view of said hooking element, taken from the left-hand side of FIG. 6*b;*

Figure 7A:
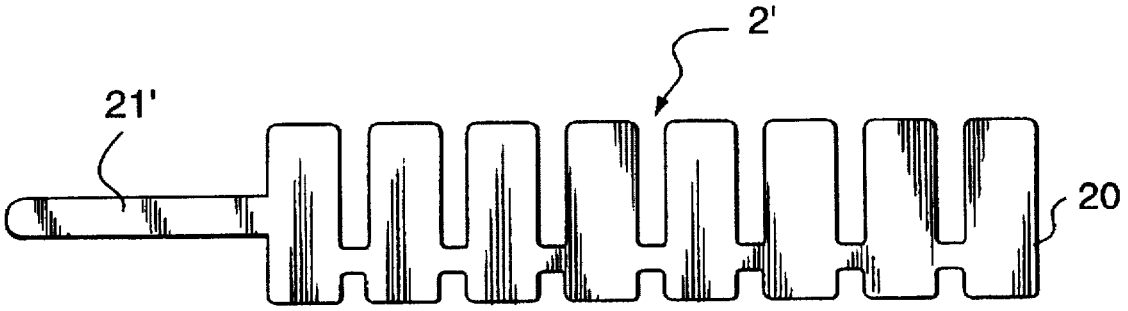
Figure 7B:
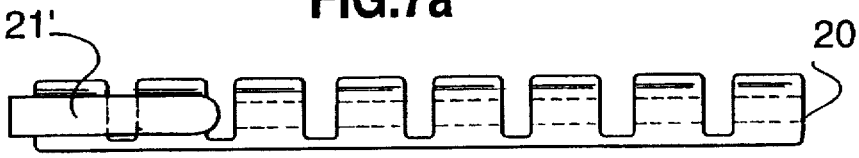
Figure 7D:
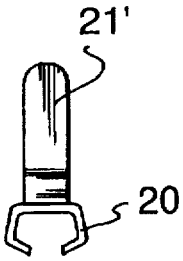
Figure 7C:
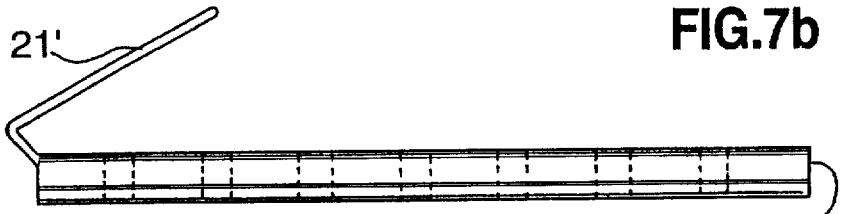

FIG. 7*a* is a plan view of a terminal metal hooking element for three-sided gaskets, before seaming;

FIG. 7*b* is a plan view of the element in FIG. 7*a* after seaming;

FIG. 7*c* is a side elevation of the element in FIG. 7*b;*

FIG. 7*d* is an end view taken from the left-hand side of FIG. 7*c;*

Figure 8A:
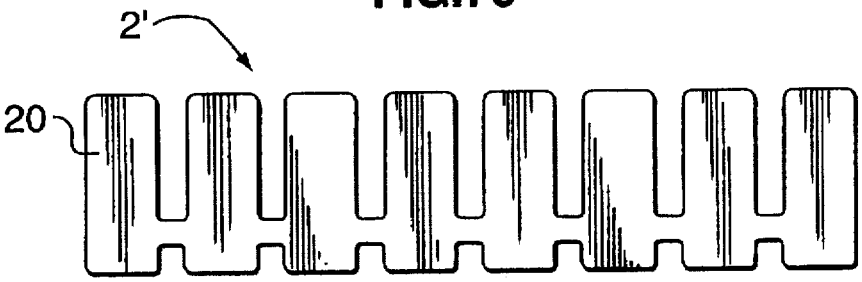
Figure 8D:
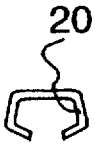
Figure 8B:
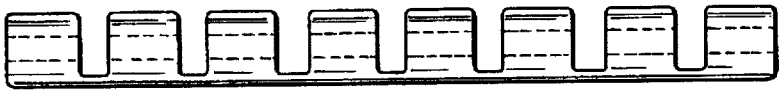
Figure 8C:
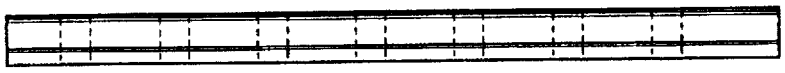

FIG. 8*a* is a plan view of a metal element suitable for making an end join in a four-sided closed-frame gasket;

FIG. 8*b* is a plan view of the element in FIG. 8*a* after seaming;

FIG. 8*c* is a side elevation of the element in FIG. 8*b;*

FIG. 8*d* is an end view taken from the left-hand side of FIG. 8*c*.

With reference to these Figures the gasket for cooking ovens according to the invention comprises a continuous elastomeric strip 1, in particular of silicone rubber, and a plurality of metal elements 2, 2', 2", whose function will be described below.

The continuous strip 1, obtained by extrusion, has a longitudinal rib 3, having a T-shape section in the attached drawings. It is obvious, however, that this rib 3 can have other shapes for the purposes of this invention, which will become clear further on and to achieve which it is sufficient for a protrusion 3 from the body 4 of the strip to be provided.

Parallel to the two sides of the, longitudinal rib 3 extend respective lips 5, 6 which improve the seal against the surface on which the gasket is applied.

A protruding, longitudinal fin 7 is provided on the opposite side of the rib 3, with an outer intermediate rib 8.

The purpose of the fin 7 and the rib 8 is to make a seal against the complementary element of the oven where the gasket is interposed, in particular against the oven door. The fin 7 can be directed, depending on the solutions adopted, so as to point either inwards, as illustrated in the attached figures, or outwards indifferently.

Figure 1:
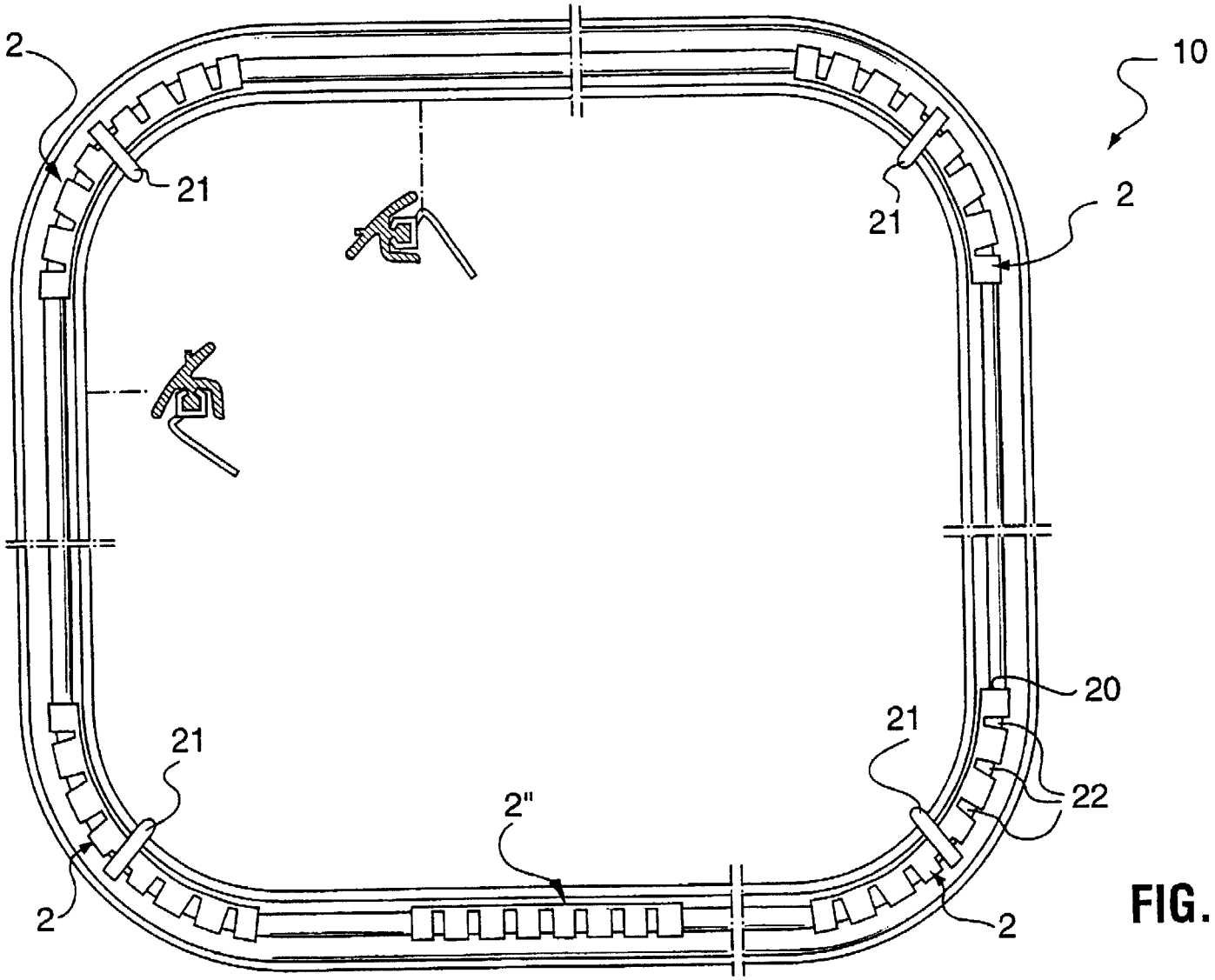
FIG. 1 is a schematic plan view of a four-sided closed-frame gasket according to the invention.
Figure 2:
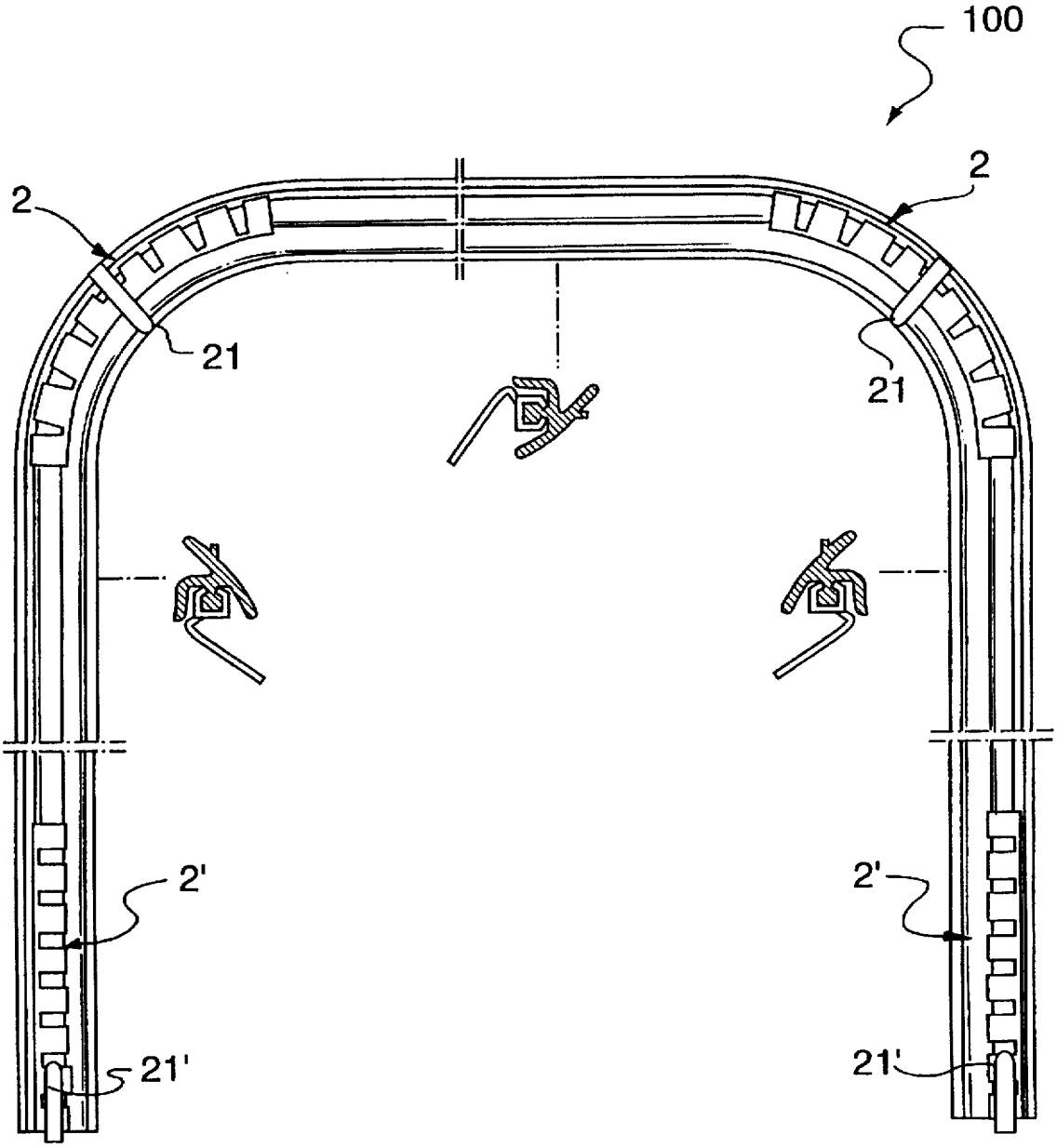
FIG. 2 is a schematic plan view of a three-sided open-frame gasket according to the invention.
Figure 3:
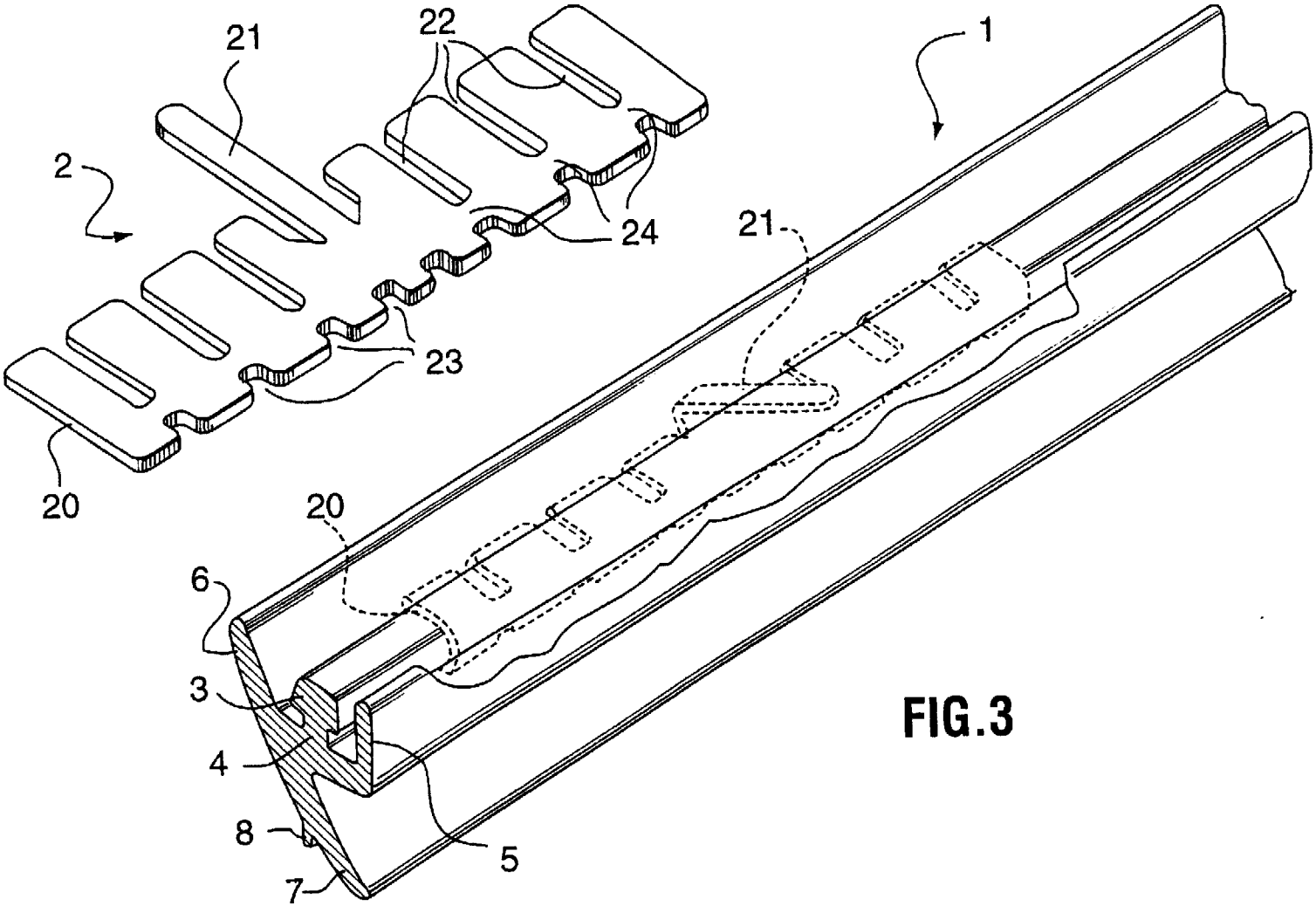
FIG. 3 is an isometric view of a section of gasket according to the invention and of a metal hooking element shown separately from the gasket before application, the same hooking element being shown by a broken line after application.
Figure 4:
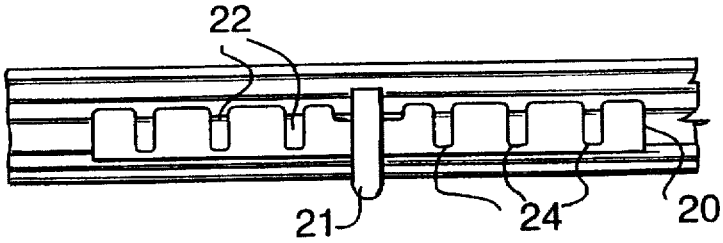
FIG. 4 is a schematic plan view of a corner hooking element, applied to a gasket, before bending.
Figure 5:
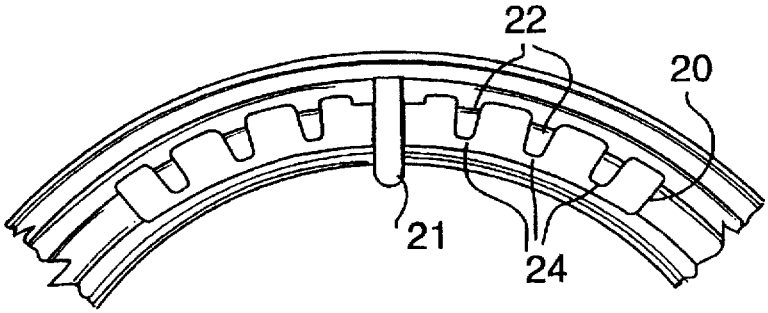
FIG. 5 is a similar view to that in FIG. 4, after bending.

FIG. 1 schematically shows a gasket 10 with four-sides forming a closed rectangular frame, whilst FIG. 2 schematically illustrates a gasket 100 with three sides, forming an open frame without a lower side.

The above mentioned metal hooking elements 2, 2' are used to fix the gaskets to the corresponding wall of the oven, whilst the metal element 2" acts as a joining element to join the ends of the closed frame gasket 10 in FIG. 1.

The structure and application procedure of the metal elements will now be described, starting from element 2 which can be placed at the corners of the gasket.

As can be seen in the attached figures, and particularly in FIG. 6, the metal element 2, advantageously obtained by shearing, has a flattened base 20 and a central element 21 protruding from one side, which is subsequently bent to form a hook. The base 20 has two series of transverse opposed notches 22, 23, the former situated on the side of the base 2 where the hook 21 is attached and being considerably deeper than the latter. This means that the base 22 is asymmetrical with respect to the longitudinal axis, having an unbroken area of material at the bridges 24 separating each pair of notches 22, 23, clearly situated more to one side of the base 20.

According to the invention, the base 20 of the metal hooking element 2 is seamed to the longitudinal rib 3 of the continuous strip 1, at pre-established points along the same, and the projection 21 is bent to form a hook, as shown particularly in FIG. 6*c*.

Thus fixing of the metal element takes place from the outside of the strip 1, without any need to make holes in the strip itself, with a simple mechanical operation that can easily be automated. In practice, the strip 1 is advanced and positioned beneath at least one vice which mechanically clinches the bases 20 on to the strip. During seaming of the base 20 onto the rib 3, a slight tension can advantageously be applied to the strip 1, so that different tensions do not occur when the gasket is in use, since it is usually stretched slightly during fitting.

As shown in the attached drawings the solid portion of the base 2, that is the portion containing the bridges 24, is disposed on the inner side of the bend made at the corner of the gasket, to give it the desired shape.

Bending of the base 20 seamed to the strip 1 to obtain the corner joins 2 shown in FIGS. 1 and 2 can be done during application of these metal elements to the strip. However, this bending is more advantageously carried out during fitting of the gaskets to the ovens. In this case, in fact, bending of the bases 20 of the metal elements 2 takes place virtually spontaneously when the installer slightly stretches the gasket to insert the hooks 21 in the corresponding holes provided on the oven wall. Obviously the distances at which the elements 2 are applied to the strip 1 are predetermined according to the distances of the corresponding engagement holes for the hooks 21, taking into account the fitting tension required by the gasket.

FIGS. 7*a*–7*d* illustrate a metal looking element 2' to be placed at or in the proximity to the free ends of the three-sided gasket shown in FIG. 2. This element 2' has a base 20 structurally the same as the base 20 of the element 2 and a hook 21' provided or the longitudinal axis of the base 20, protruding from one end of the base itself. Application of the element 2' takes place in an identical manner to the element 2, by seaming to the rib 3 of the strip 1.

FIGS. 8*a*–8*d* illustrate the metal element 2" that acts as a jointing element to make the end join of the four-sided gasket shown in FIG. 1. In practice, the element 2" comprises only the base 20 of the elements 2, 2', without the hook 21, 21'. The element 2" is seamed to the rib 3 at the adjacent ends of the strip 1, closed in a ring (FIG. 1) to hold these ends together.

Obviously the base 20 of the elements 2', 2" which must not be subjected to bending could even be symmetrical with respect to its longitudinal axis, and/or not have notches 22, 23.

The advantage in the bases 20 being all substantially the same is that the same shearing die can be used to obtain the various elements.

The shape of the base 20 of the corner element 2 is that preferred for easy bending of the metal element on the strip 1, during fitting of the gasket on the oven.

However, it is obvious that other structural arrangements of the base 20 are possible.

For example, the notches 22, 23 could have the same depth and be arranged in alternate positions, rather than in line with each other, the concept of seaming/clinching said metal elements on an outer rib of the strip 1 remaining unchanged.

As can be seen in the attached figures, the lip 6 of the strip 1, designed to be placed on the outside of the gasket when this is bent to form a frame, is longer than the lip 5, so that it covers the base 20 of the metal element when the gasket is fitted to the oven.

I claim:

1. An elastomeric sealing gasket of continuous length for cooking oven doors, the gasket comprising an elastomeric strip having a longitudinal rib, the strip being provided with at least one elongated metal element, the metal element having a base, the base having a first series of transverse notches extending from a bridge of a longitudinal continuous strip of unbroken area of material, the notches being longer than the width of the bridge creating a metal element which is asymmetrical with respect to its longitudinal axis, the metal element also having a protruding element extending therefrom which can be bent to form a hook able to engage in apertures provided in the over, the base of the metal element being mechanically seamed to the rib of the strip so that the bridge is disposed on one side of the longitudinal axis of the rib, the metal element facilitating the bending of the gasket to follow a corner of the oven door, and to facilitate proper positioning of the hook and gasket.

2. The gasket of claim 1 wherein the gasket of continuous length is selected from the group of: four-sided closed frame gaskets; and three-sided open framed gaskets.

3. The gasket of claim 2 wherein the metal element is deposed at a corner of the gasket, facilitating bending of the gasket around the corner and proper positioning of the hook in the aperture provided in the oven.

4. The gasket of claim 3 wherein the elastomeric continuous strip and metal element are bent after seaming of the metal element to the rib, upon fitting of the gasket to the oven.

5. The gasket of claim 3 wherein a metal element is deposed at each corner of the gasket.

6. The gasket of claim 1 wherein the base of the metal element has a second series of transverse notches opposing the first series of notches, the first and second series of notches positioned on either longitudinal side of the metal element, the first series of notches being longer than the second series of notches, resulting in the metal element being asymmetrical with respect to its longitudinal axis.

7. The gasket of claim 6 wherein the first series of notches are in line with the second series of notches, the first and second series of notches being separated by the bridge of a longitudinal continuous strip of unbroken area of material.

8. The gasket of claim 5 wherein the gasket is a three-sided open frame gasket, a metal element being seamed at each of the free ends of the gasket.

9. The gasket according to claim 1 wherein the gasket is a four-sided closed frame gasket formed by having a metal element for joining the ends of the strip, by means of seaming one end of the base of the metal element to the rib at one end of the strip and seaming the other end of the base of the same metal element to the rib at the other end of the strip.

10. The gasket according to claim 1 wherein the elastomeric strip is made of silicone rubber.

11. The gasket of claim 1 characterized in that the strip has two lips that run parallel on the two sides of the longitudinal rib and a fin on the opposite side to the rib.

* * * * *

UNITED STATES PATENT AND TRADEMARK OFFICE

CERTIFICATE OF CORRECTION

PATENT NO. : 5,709,390

DATED : January 20, 1998

INVENTOR(S) : Angelo Faccoli

It is certified that error appears in the above-indentified patent and that said Letters Patent is hereby corrected as shown below:

In Claim 1, line 44, delete "over" and substitute therefor ---oven---.

Signed and Sealed this

Thirty-first Day of March, 1998

Bruce Lehman

*Attest:*

BRUCE LEHMAN

*Attesting Officer*

*Commissioner of Patents and Trademarks*